US005325018A

United States Patent [19]

El-Hamamsy

[11] Patent Number: 5,325,018

[45] Date of Patent: Jun. 28, 1994

[54] ELECTRODELESS FLUORESCENT LAMP SHIELD FOR REDUCTION OF ELECTROMAGNETIC INTERFERENCE AND DIELECTRIC LOSSES

[75] Inventor: Sayed-Amr A. El-Hamamsy, Schenectady, N.Y.

[73] Assignee: General Electric Company, Schenectady, N.Y.

[21] Appl. No.: 936,495

[22] Filed: Aug. 28, 1992

[51] Int. Cl.[5] ..... H01J 1/52

[52] U.S. Cl. ..... 315/85; 315/248; 315/57; 315/267

[58] Field of Search ..... 315/57, 248, 267, 344, 315/85

[56] References Cited

U.S. PATENT DOCUMENTS

| | | | |
|---|---|---|---|
| 3,521,120 | 7/1970 | Anderson | 315/57 |
| 4,017,764 | 4/1977 | Anderson | 315/57 X |
| 4,187,447 | 2/1980 | Stout et al. | 315/57 X |

OTHER PUBLICATIONS

"Electrodeless Discharge Lamp," Kobayashi Atsushi et al., Patent abstract of Japan, publication No. JP63314752, publication date Dec. 22, 1988, abstract publication date Apr. 18, 1989, abstract vol. 013160, application date Jun. 17, 1987, application No. JP870150893.

*Primary Examiner*—Robert J. Pascal
*Assistant Examiner*—Haissa Philogene
*Attorney, Agent, or Firm*—Jill M. Breedlove; Marvin Snyder

[57] ABSTRACT

An electrodeless fluorescent lamp of the type having a solenoidal drive coil wound about a ferrite core includes an inner shield between the coil and the core and further includes an outer shield about the coil. The shields are preferably constructed of sheets of flexible polyimide material with vertical bands of metal etched thereon. The metal bands are connected to ground in order to shield the core and the plasma from the electric field generated about the drive coil. By thus shielding the core, the capacitance between the coil and the core is effectively short-circuited, substantially reducing or eliminating dielectric losses of the core. The outer shield substantially reduces the EMI generated by the drive coil.

13 Claims, 6 Drawing Sheets

ELECTRODELESS FLUORESCENT LAMP SHIELD FOR REDUCTION OF ELECTROMAGNETIC INTERFERENCE AND DIELECTRIC LOSSES

FIELD OF THE INVENTION

The present invention relates generally to fluorescent lamps and, more particularly, to a shield for an electrodeless fluorescent lamp for reducing electromagnetic interference (EMI) and dielectric losses of the core of a solenoidal drive coil.

BACKGROUND OF THE INVENTION

Electrodeless fluorescent lamps generally require lower electrical power to operate than conventional incandescent lamps and are generally more efficient than incandescent lamps on a lumens per Watt basis. Some electrodeless fluorescent lamps have therefore been designed to replace incandescent lamps in standard fixtures. Like typical incandescent lamps, an electrodeless fluorescent lamp has a spherical bulb, or outer envelope. The bulb of an electrodeless fluorescent lamp contains a conventional fluorescent lamp fill, i.e., a mixture of a rare gas (e.g., krypton and/or argon) and mercury vapor or cadmium vapor. A solenoidal drive coil is situated within a re-entrant cavity within the bulb. In some electrodeless fluorescent lamps, the drive coil is wound about a ferrite rod which functions as a transformer core, with the coil functioning as the transformer primary and the gaseous fill functioning as the transformer secondary.

Upon excitation by a radio frequency power supply, current flows through the drive coil, establishing a radio frequency magnetic field within the bulb which ionizes and excites the gas contained therein, resulting in an ultraviolet discharge. Ultraviolet radiation from the discharge is absorbed by a phosphor coating on the interior surface of the bulb, thereby stimulating the emission of visible radiation by the lamp.

One problem with electrodeless fluorescent lamps is that the electric field between the coil and the plasma results in the flow of EMI currents. Such EMI currents typically exceed the limits set by regulatory agencies (e.g., the Federal Communication Commission in the U.S.A.). Furthermore, for electrodeless fluorescent lamps employing a ferrite core, the electric field between the core and the coil induces the flow of current in the core, resulting in additional losses, which may cause overheating of the core and extinguishing of the discharge.

Accordingly, it is desirable to reduce the EMI generated by electrodeless fluorescent lamps, thus rendering them practical for widespread replacement of incandescent lamps, and to reduce the dielectric losses of electrodeless fluorescent lamps which employ ferrite cores.

SUMMARY OF THE INVENTION

An electrodeless fluorescent lamp of the type having a solenoidal drive coil wound about an inductive core includes an inner shield between the coil and the core and further includes an outer shield about the coil. The shields are preferably constructed of sheets of flexible dielectric material with vertical bands of metal parallel to the axis of the core etched thereon. The metal bands are connected to ground in order to shield the core and the plasma from the electric field generated about the drive coil. By thus shielding the core, the capacitance between the coil and the core is effectively short-circuited, substantially reducing or eliminating dielectric losses of the core. The outer shield substantially reduces the EMI generated by the drive coil.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
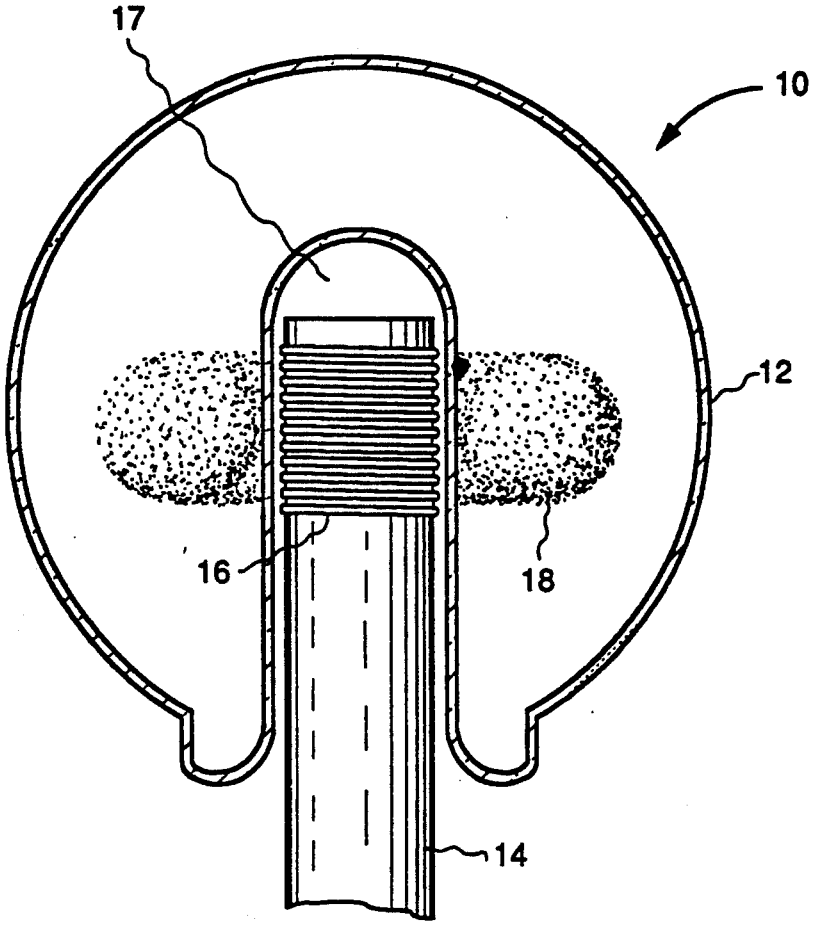
FIG. 1 illustrates, in partial cross section, a typical electrodeless fluorescent lamp.

FIG. 1 illustrates a typical electrodeless fluorescent lamp 10 having a spherical bulb or envelope 12 containing an ionizable gaseous fill. A suitable fill, for example, comprises a mixture of a rare gas (e.g., krypton and/or argon) and mercury vapor and/or cadmium vapor. An induction transformer core 14 (e.g., of ferrite) having a coil, or winding, 16 thereon is situated within a re-entrant cavity 17 formed in envelope 12. The interior surfaces of envelope 12 are coated in well-known fashion with a suitable phosphor which is stimulated to emit visible radiation upon absorption of ultraviolet radiation. Envelope 12 fits into a standard base assembly (e.g., a standard Edison type screw plug, not shown) for connection to a radio frequency power supply which may be located in the lamp base or external to it, as desired.

In operation, current flows through winding 16, establishing a radio frequency magnetic field in transformer core 14. The magnetic field within transformer core 14 induces an electric field within envelope 12 which ionizes and excites the gas contained therein, resulting in an ultraviolet discharge 18. Ultraviolet radiation from discharge 18 is absorbed by the phosphor coating on the interior surface of the lamp, thereby stimulating the emission of visible radiation by the lamp.

In accordance with the present invention, an inner shield is situated between core 14 and winding 16; and on outer shield is situated about winding 16. The inner shield functions to short circuit the capacitance between the winding and the core, thereby substantially reducing or eliminating dielectric losses of the core; and the outer shield substantially reduces EMI generated by the winding.

Figure 2A:
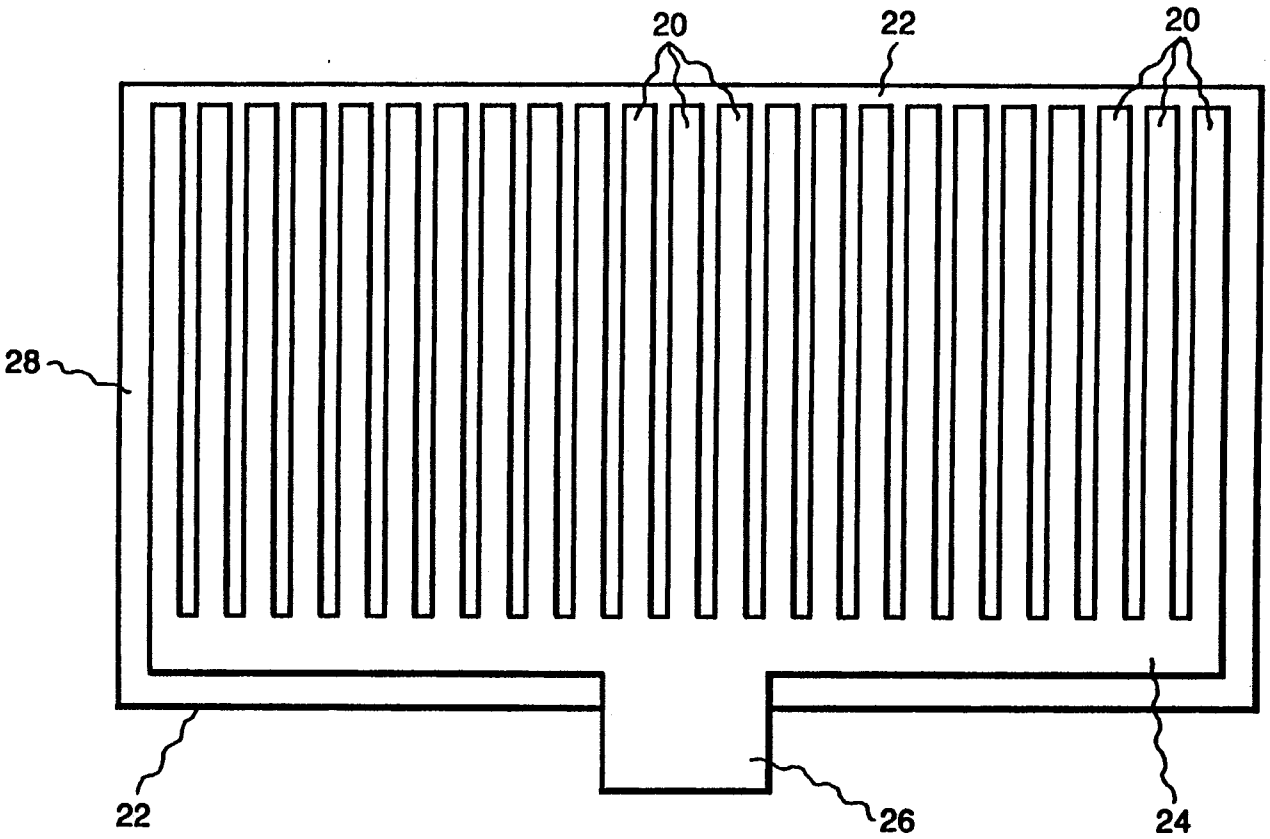
FIGS. 2*a* and 2*b* are front and perspective illustrations, respectively, of a shield configuration for an electrodeless fluorescent lamp according to the present invention.
Figure 2B:
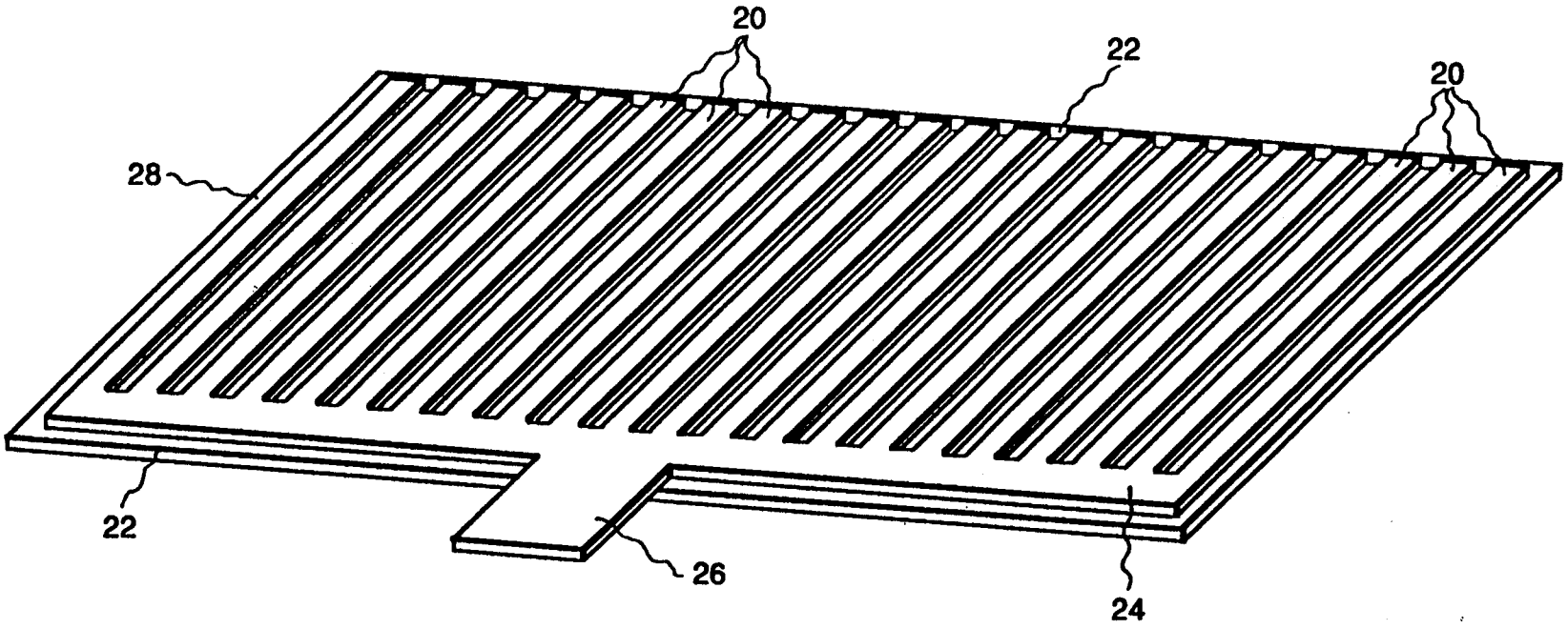

FIG. 2*a* illustrates in planar view a preferred configuration for inner and outer shields according to the present invention. FIG. 2*b* is a perspective view of the shield of FIG. 2*a*. The shield comprises vertical metal bands 20 (e.g., copper) etched onto a dielectric sheet 22 (e.g., Kapton polyimide film manufactured by E.I. du Pont de Nemours and Company). The metal bands 20 are not continuous in the azimuthal direction in order to minimize eddy currents that would effectively short circuit the plasma. Furthermore, the metal bands are sufficiently thin so as to avoid carrying eddy currents in the cross section thereof which would add losses to the coil.

Metal bands 20 are coupled together by a horizontal conductor 24 etched in the bottom portion of dielectric sheet 22. By locating the horizontal conductor at the bottom of the structure, it has minimal impact on the magnetic field established about winding 16. A copper tab 26 is provided for connection of conductor 24 to circuit ground in order to shield the core and the plasma from the electric field generated about the winding. Sufficient spacing 28 is provided on each side of the laminate so as to ensure that the horizontal connection 24 does not form a shorted turn when the flexible shield is wrapped around the core.

Advantageously, the use of a copper/Kapton polyimide film laminate results in a very thin shield which does not require much space in the re-entrant cavity of the lamp. Moreover, use of a thin conductor reduces any eddy current losses. And, although a continuous metal band could be employed, rather than a plurality of bands as shown, use of a plurality of metal bands also minimizes eddy currents. As still another advantage, Kapton polyimide film has a very high field breakdown characteristic, so that the winding and shield can be situated in close proximity without danger of dielectric breakdown due to the electric field of the coil.

Figure 3A:
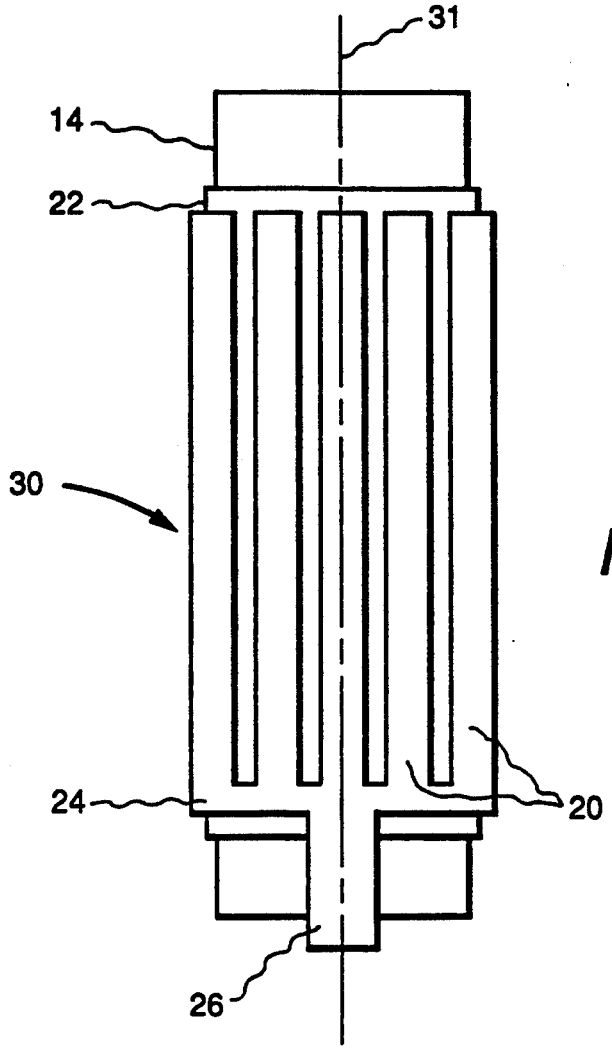
FIGS. 3*a*–3*b*, 4*a*–4*b*, and 5*a*–5*b* illustrate construction of an electrodeless fluorescent lamp with inner and outer shields according to the present invention.
Figure 3B:
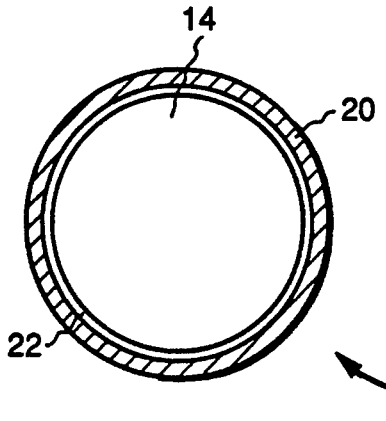

FIGS. 3*a* and 3*b* illustrate an inner shield 30, configured as in FIG. 2, wrapped around core 14 such that bands 20 are parallel to the longitudinal axis 31 of the core. Although the Kapton polyimide film is shown as being situated adjacent the core with copper bands 20 exposed, the copper bands could be alternatively situated adjacent the core in order to use the dielectric strength of the polyimide film to sustain the field between the winding and the shield, if desired.

Figure 4A:
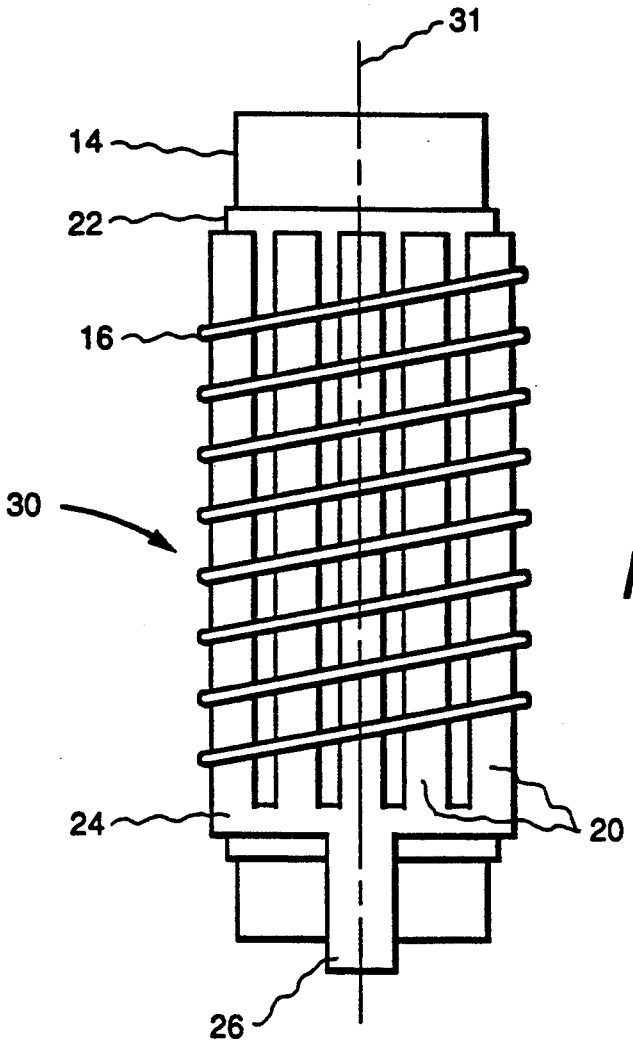
Figure 4B:
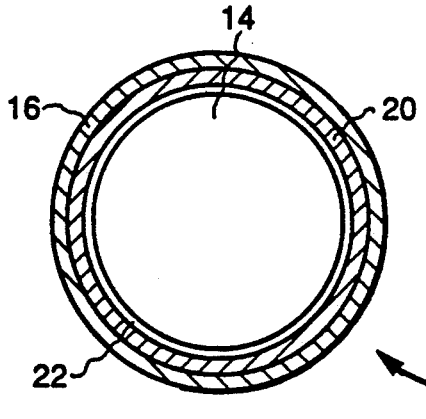
Figure 5A:
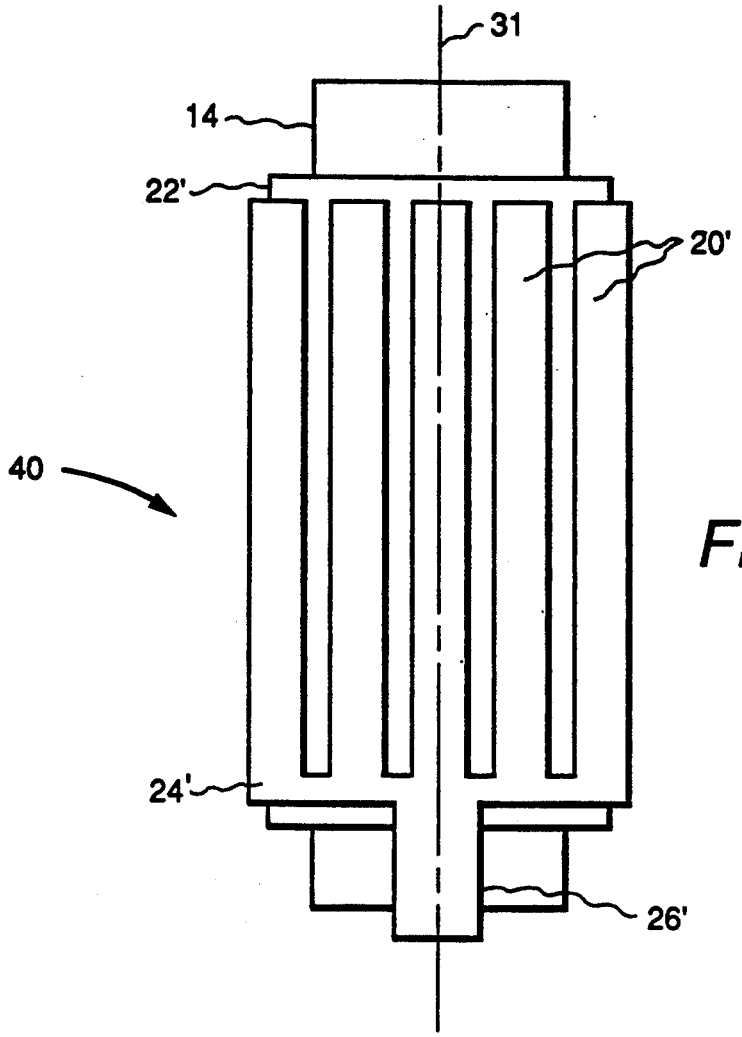
Figure 5B:
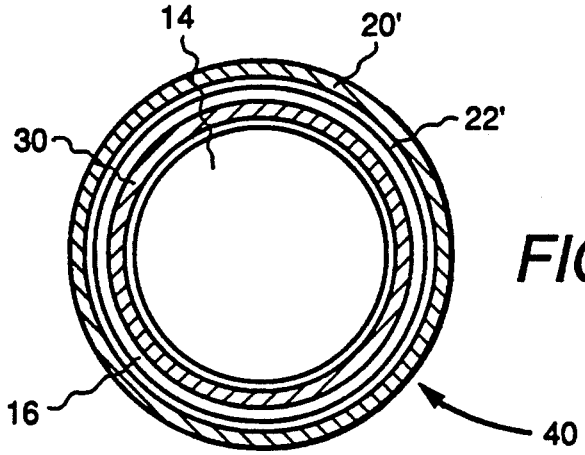

FIGS. 4*a* and 4*b* illustrate how winding 16 is situated about inner shield 30; and FIGS. 5*a* and 5*b* show the position of an outer shield 40, configured as in FIG. 2, about the winding. (In FIGS. 5*a*–5*b*, the primed numbers are used to distinguish the elements of inner shield 30 from those of outer shield 40.)

According to an alternative embodiment, the outer shield 40 is made shorter than drive coil 16, with at least the top turn of the coil being exposed, such that the electric field lines from the top turn of the coil to the grounded shield penetrate the discharge and ensure breakdown of the gas for ignition of the lamp.

For electrodeless fluorescent lamps employing a solenoidal drive coil without a ferrite core, an outer shield according to the present invention may be situated about the winding in order to advantageously reduce EMI generated thereby.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An electrodeless fluorescent lamp, comprising:

a light-transmissive envelope containing an ionizable, gaseous fill for sustaining an arc discharge when subjected to a radio frequency magnetic field and for emitting ultraviolet radiation as a result thereof, said envelope having an interior phosphor coating for emitting visible radiation when excited by said ultraviolet radiation;

a winding disposed about an inductive core and situated within said envelope for coupling to a radio frequency supply and establishing said radio frequency magnetic field about said winding, said inductive core being cylindrical with a longitudinal axis;

an EMI shield wrapped about said winding, said EMI shield comprising a plurality of metal bands disposed on a flexible dielectric material, said metal bands being parallel to the longitudinal axis of said core, said metal bands being discontinuous in an aximuthal direction so as to avoid short-circuiting said discharge, said metal bands being coupled to a circuit ground; and an inner shield disposed between said core and said winding, said inner shield comprising a plurality of metal bands disposed on a dielectric material, said metal bands being coupled to said circuit ground.

2. The electrodeless fluorescent lamp of claim 1 wherein said metal bands of said EMI shield are coupled together by a conductor situated perpendicular thereto.

3. The electrodeless fluorescent lamp of claim 2 wherein said conductor is situated toward the bottom of said envelope.

4. The electrodeless fluorescent lamp of claim 1 wherein said metal bands of said EMI shield are comprised of copper.

5. The electrodeless fluorescent lamp of claim 1 wherein said dielectric material of said EMI shield is comprised of a polyimide film.

6. The electrodeless fluorescent lamp of claim 1 wherein said metal bands of said inner shield are parallel to the longitudinal axis of said core.

7. The electrodeless fluorescent lamp of claim 6 wherein said metal bands of said inner shield are coupled together by a conductor situated perpendicular thereto.

8. The electrodeless fluorescent lamp of claim 7 wherein said conductor is situated toward the bottom of said envelope.

9. The electrodeless fluorescent lamp of claim 1 wherein said metal bands of said inner shield are comprised of copper.

10. The electrodeless fluorescent lamp of claim 1 wherein said dielectric material of said inner shield is comprised of a polyimide film.

11. The electrodeless fluorescent lamp of claim 1 wherein said EMI shield covers all turns of said winding.

12. The electrodeless fluorescent lamp of claim 1 wherein at least one turn of said winding is not covered by said EMI shield.

13. The electrodeless fluorescent lamp of claim 12 wherein said one turn comprises the top turn of said coil.

* * * * *